US007142081B1

(12) United States Patent
Shudarek

(10) Patent No.: US 7,142,081 B1
(45) Date of Patent: Nov. 28, 2006

(54) MULTIPLE THREE-PHASE INDUCTOR WITH A COMMON CORE

(75) Inventor: Todd A. Shudarek, West Bend, WI (US)

(73) Assignee: MTE Corporation, Menomonee Falls, WI (US)

( * ) Notice: Subject to any disclaimer, the term of this patent is extended or adjusted under 35 U.S.C. 154(b) by 137 days.

(21) Appl. No.: 11/120,795

(22) Filed: May 3, 2005

(51) Int. Cl.
*H01F 17/06* (2006.01)

(52) U.S. Cl. ..... 336/178

(58) Field of Classification Search ..... 336/83, 336/170, 178, 212, 233–234
See application file for complete search history.

(56) References Cited

U.S. PATENT DOCUMENTS

| | | | | |
|---|---|---|---|---|
| 1,920,948 | A | 8/1933 | Crouse | |
| 2,137,433 | A * | 11/1938 | Wirz | 336/160 |
| 2,311,128 | A * | 2/1943 | Ranney | 336/61 |
| 2,418,643 | A * | 4/1947 | Huge | 363/172 |
| 3,710,233 | A | 1/1973 | Borkovitz | |
| 4,206,434 | A | 6/1980 | Hase | |
| 4,422,056 | A | 12/1983 | Roberts | |
| 4,488,136 | A * | 12/1984 | Hansen et al. | 336/215 |
| 4,531,108 | A | 7/1985 | Brandes | |
| 4,951,024 | A | 8/1990 | Stelter et al. | |
| 5,146,198 | A | 9/1992 | Pollard et al. | |
| 5,177,460 | A * | 1/1993 | Dhyanchand et al. | 336/12 |
| 5,182,535 | A * | 1/1993 | Dhyanchand | 336/12 |
| 5,537,089 | A | 7/1996 | Greif et al. | |
| 6,127,743 | A | 10/2000 | Levin et al. | |
| 6,166,531 | A | 12/2000 | Hogan et al. | |
| 6,339,265 | B1 | 1/2002 | Levin et al. | |
| 6,466,466 | B1 | 10/2002 | Karlsson et al. | |
| 6,737,951 | B1 | 5/2004 | Decristofaro et al. | |
| 6,809,620 | B1 | 10/2004 | Hoglund | |
| 2002/0075118 | A1 * | 6/2002 | Klaassen | 336/212 |
| 2004/0212269 | A1 | 10/2004 | Decristofaro et al. | |
| 2005/0030140 | A1 | 2/2005 | Dahlgren et al. | |

FOREIGN PATENT DOCUMENTS

| | | |
|---|---|---|
| JP | 62137813 | 6/1987 |

* cited by examiner

*Primary Examiner*—Tuyen T Nguyen
(74) *Attorney, Agent, or Firm*—Quarles & Brady LLP; George E. Haas

(57) ABSTRACT

An electrical inductor assembly has a plurality of three-phase inductors on a common core. Each inductor includes three coils wound around separate legs of the core. Core bridges extend across the legs to provide an inter-leg path for the magnetic flux produced by each coil. The magnetic flux from all the coils of adjacent inductors flows through a common core bridge in a manner wherein the magnetic flux in the common core bridge is less than the sum of the magnetic fluxes in each leg.

20 Claims, 3 Drawing Sheets

MULTIPLE THREE-PHASE INDUCTOR WITH A COMMON CORE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to inductors, such as those used in electrical filters, and more particularly to three-phase electrical inductors.

2. Description of the Related Art

AC motors often are operated by motor drives in which both the amplitude and the frequency of the stator winding voltage are controlled to vary the rotor speed. In a normal operating mode, the motor drive switches voltage from a source to create an output voltage at a particular frequency and magnitude that is applied to drive the electric motor at a desired speed.

When the mechanism connected to the motor decelerates, the inertia of the that mechanism causes the motor to continue to rotate even if the electrical supply is disconnected. At this time, the motor acts as a generator producing electrical power while being driven by the inertia of its load. In a regenerative mode, the motor drive conducts that generated electricity from the motor to an electrical load, such as back to the supply used during normal operation. The regeneration can be used to brake the motor and its load. In other situations, the regenerative mode can be employed to recharge batteries or power other equipment connected to the same supply lines that feed the motor drive during the normal operating mode.

Electrical filters are often placed between the electric utility supply lines and the motor drive to prevent electricity at frequencies other than the nominal utility line frequency (50 Hz or 60 Hz) from being applied from the motor drive onto the supply lines. It is undesirable that such higher frequency signals be conducted by the supply lines as that might adversely affect the operation of other electrical equipment connected to those lines. In the case of a three-phase motor drive, a filter comprising one or more inductors and other components for each phase line has been used to couple the motor drive to the supply lines and attenuate the undesirable frequencies. Such inductors are wound on an iron core which adds substantial weight to the motor drive.

Thus, it is desirable to minimize the weight and size of the inductors used in the electrical supply line filters.

SUMMARY OF THE INVENTION

An electrical inductor assembly comprises a core having first, second and third core bridges of magnetically permeable material and located spaced from and substantially parallel to each other. First, second and third legs, also of magnetically permeable material, extend between the first core bridge and the second core bridge with each such leg being separated by a gap from one of the first and second core bridges. Fourth, fifth and sixth legs, of magnetically permeable material, are between the second core bridge and the third core bridge and separated by a gap from one of the second and third core bridges.

First, second, third, fourth, fifth and sixth electrical coils are each wound around a different one of the first, second, third, fourth, fifth and sixth legs, wherein electric currents flowing through those electrical coils produce magnetic flux which flows through the second core bridge. In a preferred embodiment, the magnetic flux produced by the first, second, and third electrical coils flows through the second core bridge in an opposite direction to magnetic flux produced by the fourth, fifth and sixth electrical coils. This produces a flux density in the second core bridge that is less than a sum of flux densities in each of the first, second, third, fourth, fifth and sixth legs. This produces a magnetic flux in the second core bridge that is less than a sum of the magnetic fluxes contained in each of the first, second, third, fourth, fifth and sixth legs.

In a specific implementation of the electrical inductor assembly, the first electrical coil is connected to the fourth electrical coil wherein current flowing there through produces magnetic flux flowing through the second core bridge in opposite directions. The second electrical coil is connected to the fifth electrical coil wherein current flowing there through produces magnetic flux flowing through the second core bridge in opposite directions. The third electrical coil is connected to the sixth electrical coil wherein current flowing there through produces magnetic flux flowing through the second core bridge in opposite directions.

DETAILED DESCRIPTION OF THE INVENTION

Figure 1:
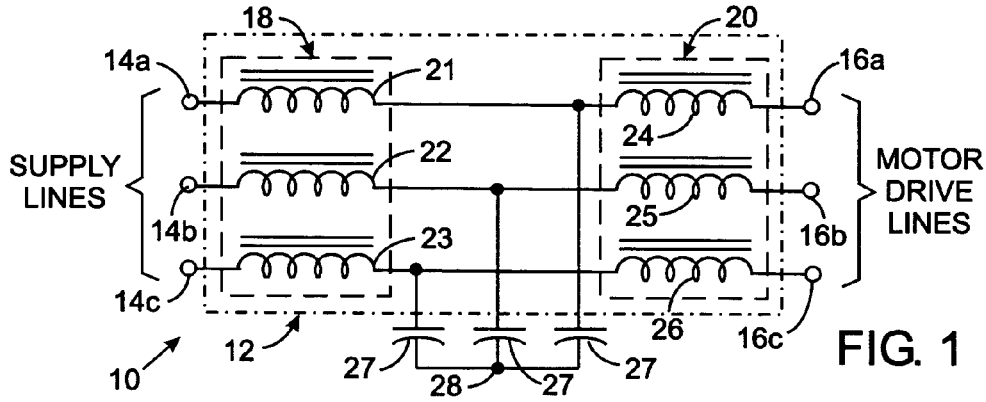
FIG. 1 is a schematic circuit diagram of a filter with an plurality of inductors used to couple a regenerative motor drive to electrical supply lines.

With initial reference to FIG. 1, an electrical filter 10 for a regenerative motor drive has an inductor assembly 12 for the three phases of electricity applied from a power supply lines to the motor drive. The filter 10 has three input terminals 14*a*, 14*b*, and 14*c* for connection to the three-phase electrical supply lines. Three output terminals 16*a*, 16*b*, and 16*c* are provided for connection to the regenerative motor drive.

A first three-phase inductor 18 and a second three-phase inductor 20 are connected in series between the input terminals 14*a–c* and the output terminals 16*a–c*. The first three-phase inductor 18 has a first coil 21, a second coil 22, and a third coil 23; and the second three-phase inductor 20 has a fourth coil 24, a fifth coil 25, and a sixth coil 26. The first and fourth coils 21 and 24 are connected in series between one set of input and output terminals 14*a* and 16*a*. Similarly, the second and fifth coils 22 and 25 are connected in series between input and output terminals 14*b* and 16*b*, while the third and sixth coils 23 and 26 are connected between the third pair of input and output terminals 14*c* and 16*c*. The filter 10 also includes three capacitors 27, each connected between a common node 28 and a node between a different series connected pair of the inductor coils 21–26.

Figure 2:
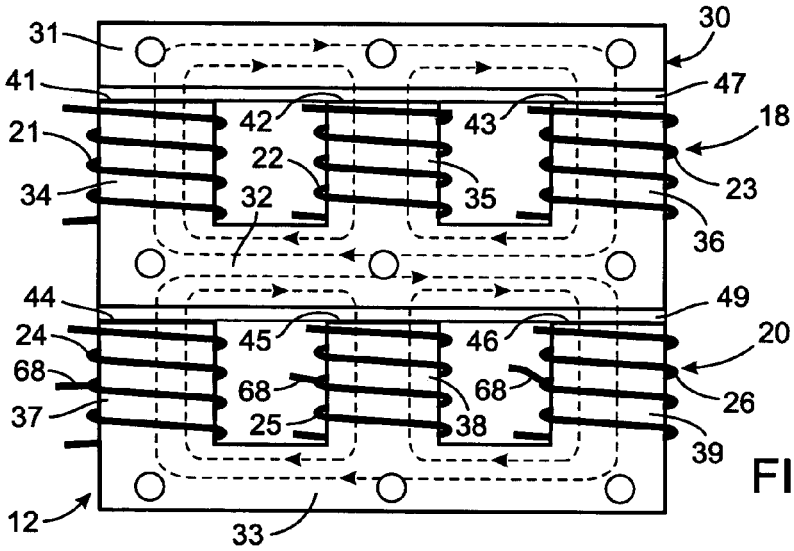
FIG. 2 is a schematic representation of an inductor assembly for the filter, in which the sets of coils for two three-phase inductors are wound on a common core.

With reference to FIG. 2, the six inductor coils 21–26 are wound on a common core 30 formed of steel or other material which has a relatively high permeability as conventionally used for inductor cores. The core 30 comprises three core bridges 31, 32, and 33 and six legs 34, 35, 36, 37, 38 and 39, that are formed as laminations of a plurality of plates places side-by-side as is conventional practice. As used herein, "high permeability" means a magnetic permeability that is at least 1000 times greater than the permeability of air, and "low permeability" means a magnetic permeability that is less than 100 times the permeability of air.

The core bridges 31, 32, and 33 are spaced apart substantially parallel to each other and extend across the full width of the core 30 in the orientation shown in the drawings. The first inductor 18 utilizes the first and second core bridges 31 and 32 between which extend the first, second, and third legs 34, 35, and 36. In the illustrated embodiment, these three legs 34–36 are contiguous with and extend outwardly from the second core bridge 32 and combine to form a first core element resembling a capital English letter "E". The remote ends of first, second, and third legs 34–35 face the first core bridge 31 and are spaced therefrom by a low permeability gaps 41, 42, and 43, respectively. A spacer 47 of low permeability material is placed in each gap and may be made of a synthetic aramid polymer, such as available under the brand name NOMEX® from E. I. du Pont de Nemours and Company, Wilmington, Del., U.S.A. Alternatively an air gap may be provided between each leg 34–35 and the first core bridge 31. As a further alternative, the gaps 41, 42 and 43 can be located between the first, second, and third legs 34, 35 and 36 and the second core bridge 32, in which case the legs would be contiguous with the first core bridge 31.

The fourth, fifth, and sixth legs 37, 38, and 39 project from the third core bridge 33 toward the second core bridge 32 thereby forming a second core element resembling a capital English letter "E". The remote ends of the fourth, fifth, and sixth legs 37–39 are spaced from the second a bridge 32 by a gap 44, 45, and 46 which creates an area of relatively low magnetic permeability along each leg. A low permeability spacer 49 is placed in the gaps 44, 45, and 46, however an air gap alternatively may be provided between each leg 37–39 and the second core bridge 32. In an alternative version of the core 30, the gaps 44, 45, and 46 could be located between the fourth, fifth, and sixth legs 37–39 and the third core bridge 33, in which case the legs would be contiguous with the second core bridge 32. Additional gaps may be provided along each leg 34–39.

Each of the coils 21–23 of the first inductor 18 is wound in the same direction around a different one of the first, second, and third core legs 34–36. The winding of the first inductor coils 21–23 about the core legs 34–36 is such that when current flows through each coil 21–23 in a direction from its input terminal 14*a, b* or *c* to the associated output terminal 16 *a, b* or *c*, the magnetic flux produced by each coil flows in the same direction through the first core bridge 31 and in the same direction in the second core bridge 32 as represented by the dashed lines with arrows. Note that each magnetic flux path for the first inductor 18 traverses two of the gaps 41, 42 and 43 in the core 30. The magnetic flux produced by the first inductor 18, for all practical design purposes, does not flow through the third core bridge 33 as that path requires traversing four of the gaps 41–46 in the core 30, thereby encountering a significantly greater reluctance than the illustrated paths. In other words there is negligible magnetic coupling between the core sections for the first and second inductors 18 and 20.

Each of the fourth, fifth, and sixth coils 24, 25, and 26 of the second inductor 20 is wound in the same direction around a different one of the fourth, fifth, and sixth legs 37, 38, and 39. Therefore, when electric current flows from the input terminals 14*a–c* to the output terminals 16*a–c* magnetic flux produced from each coil will flow the same direction through the second core bridge 32 and in the same direction through the third core bridge 33 as denoted by the dashed lines with arrows. Each magnetic flux path for the second inductor 20 traverses two of the core gaps 44, 45 and 46. The magnetic flux produced by the second inductor 20, for all practical design purposes, does not flow through the first core bridge 31 as that path traverses four gaps in the core 30, thereby having a significantly greater reluctance than the illustrated paths. In other words there is negligible magnetic coupling between the core sections for the first and second inductors 18 and 20.

Current flowing through the pair of inductor coils (21, 24), (22, 25) or (23, 26) for a given electrical phase produces magnetic flux that flows in opposite directions through the common second core bridge 32 that is shared by the two inductors 18 and 20. For example, the first and fourth coils 21 and 24 are wound around the respective core legs 34 and 37 so that each coil produces magnetic flux flowing in a clockwise direction when current flows in a given direction between the associated input and output terminals 14*a* and 16*a* of the filter 10. The magnetic flux from each coil 21 and 24 flows in opposite directions through the second core bridge 32. The same is true for the magnetic flux from the other pairs of coils (22, 25) and (23, 26). As a result, the magnetic flux contained in the second core bridge 32, that is shared by both inductors 18 and 20, is less than the sum of the magnetic fluxes contained within the six core legs 34–39. This allows the size of the second core bridge 32 to be smaller than the equivalent core bridge required for only one of the inductors 18 or 20. In other words by combining the two inductors 18 and 20 onto a common core, portions of that core can be reduced in size so that the weight of the inductor assembly is less than the total weight of two separate cores conventionally used for inductors 18 and 20. Likewise the size of the present combined core assembly is less than the overall size of two separate cores. This results in a filter 10 that is lighter weight and smaller in size than conventional filter practice would dictate.

Figure 3:
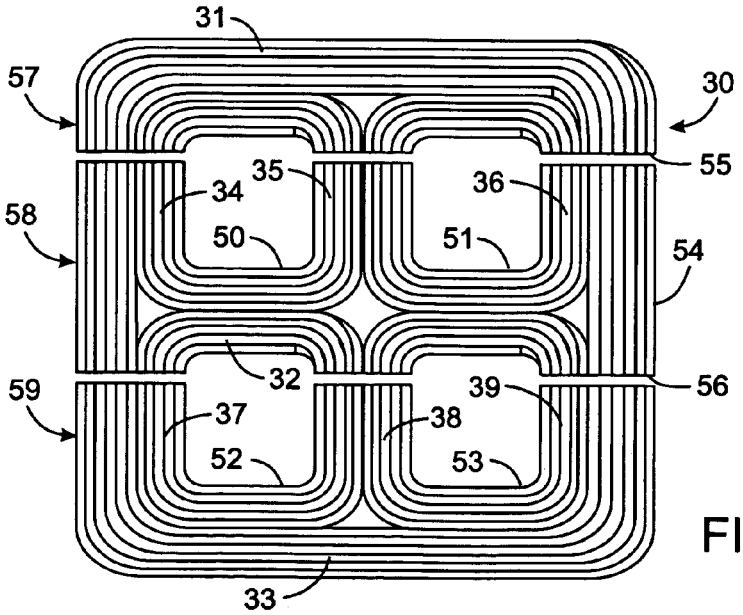
FIG. 3 illustrates a wound core for the inductor assembly.

FIG. 3 shows an alternative structure of the core 30 that is constructed of five segments 50–54. Four inner segments 50, 51, 52 and 53 have identical shapes, each formed by winding a strip of steel or other magnetically permeable material in a tight spiral with a center opening. The four inner segments 50–53 that are placed adjacent one another in a two dimensional square array. The fifth segment 54 is formed by winding another strip of the same magnetically permeable material in a spiral around the array of the inner segments 50–53. Epoxy or adhesive tape is used to hold the wound segments together. The assembled core is cut along lines 55 and 56 to form three sections 57, 58 and 59 of the core 30. In comparison to FIG. 2 the uppermost section 57 corresponds to the first core bridge 31. The intermediate section 58 corresponds to the second core bridge 32 and the first, second and third legs 34, 35 and 36, while the bottom section 59 forms the third core bridge 33 and the fourth, fifth and sixth legs 37, 38 and 39. Note that because the cut lines 55 and 56 are spaced along the sides of the inner segments, portions of the first core bridge 31 has three tabs projecting toward the first, second and third legs 34–36, and the second core bridge 32 has a similar trio of tabs projecting toward the fourth, fifth and sixth legs 37–39. Looked at another way, the gaps in the core do not have to be located precisely at the junction of each leg and the cross member of the adjacent core bridge.

Figure 4:
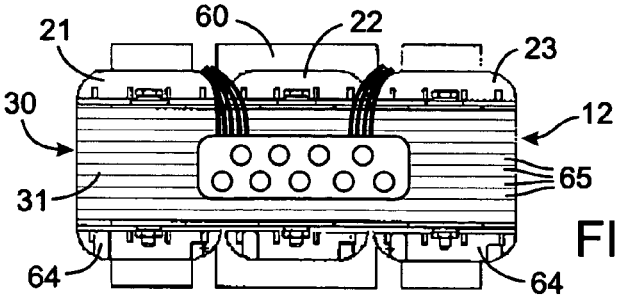
FIGS. 4, 5 and 6 are views of different sides of the inductor assembly.
Figure 5:
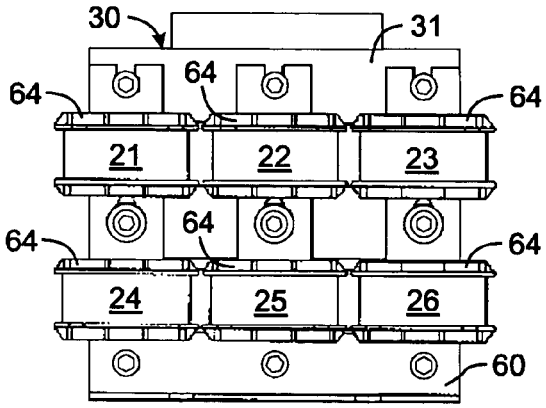
Figure 6:
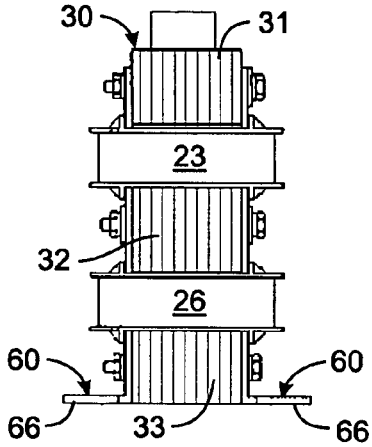
Figure 7:
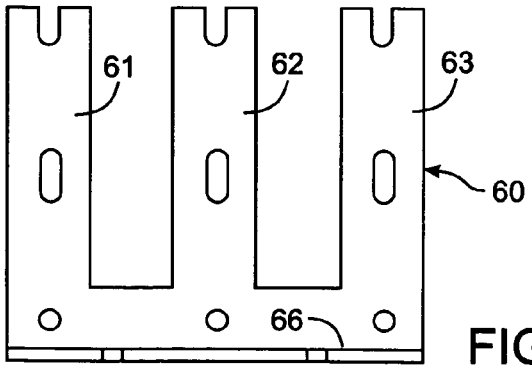
FIG. 7 is an elevational view of a mounting bracket in the inductor assembly.

FIGS. 4–6 illustrate different side views of the inductor assembly 12 with the core configuration shown in FIG. 2. The core components are formed by a lamination of metal plates 65 sandwiched between and supported by a pair of low magnetically permeable brackets 60, one of which is shown in detail in FIG. 7. The brackets 60 are L-shaped with three upstanding bars 61, 62, and 63 that project parallel to the core legs 34–39 and are secured to the three core bridges by bolts. Each inductor coil 21–26 is wound around a separate plastic bobbin 64 that has a center aperture through which the associated core leg and the bracket bar extend. Each of the brackets has a short base portion 66 for securing the inductor assembly 12 to an enclosure or other support.

With reference again to FIG. 2, the inductor coils 21–26 may have taps between their ends. For example, the fourth, fifth and sixth inductor coils 24–26 have intermediate taps 68. Each of these coils 24–26 is wound on a separate bobbin with a tap 68 connected at some point between the ends of that winding thereby creating two coil segments. Thus, each tapped coil with two segments is equivalent to two individual inductor coils wound on the same leg of the core 30. One of those individual inductor coils is formed between one end of the winding and the tap 68, with the other inductor coil formed between the tap and the other end of the winding.

Figure 8:
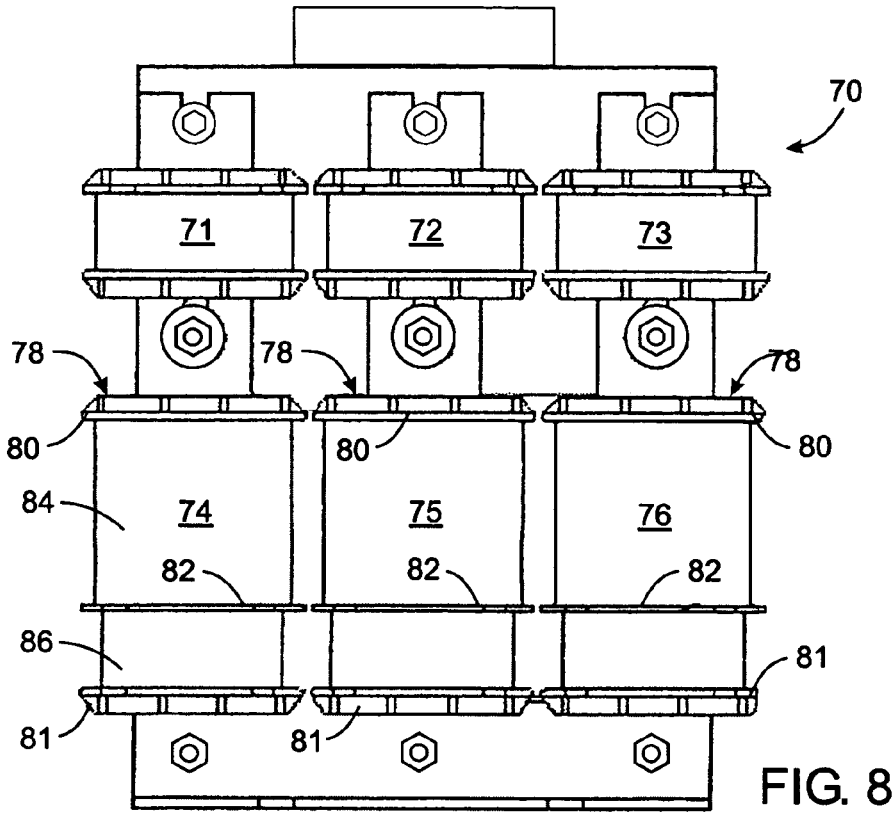
FIG. 8 is a side view of another version of the inductor assembly.

FIG. 8 illustrates an alternative inductor assembly 70 of tapped coils. Here the first second and third inductor coils 71, 72 and 73 are the same as the first second and third coils 21, 22 and 23 in FIG. 5. However the fourth, fifth and sixth inductor coils 74, 75 and 76 are each wound on a separate double bobbin 78 that has upper and lower sections 80 and 81 which are separated by an intermediate wall 82. Each of the fourth, fifth and sixth inductor coils 74–76 is formed by two segments connected in series with a tap there between. For example, the fourth inductor coil 74 has a first segment 84 wound on the upper bobbin section 80 and a second segment 86 that is wound on the lower bobbin section 81 with the intermediate wall 82 separating those coil segments.

Figure 9:
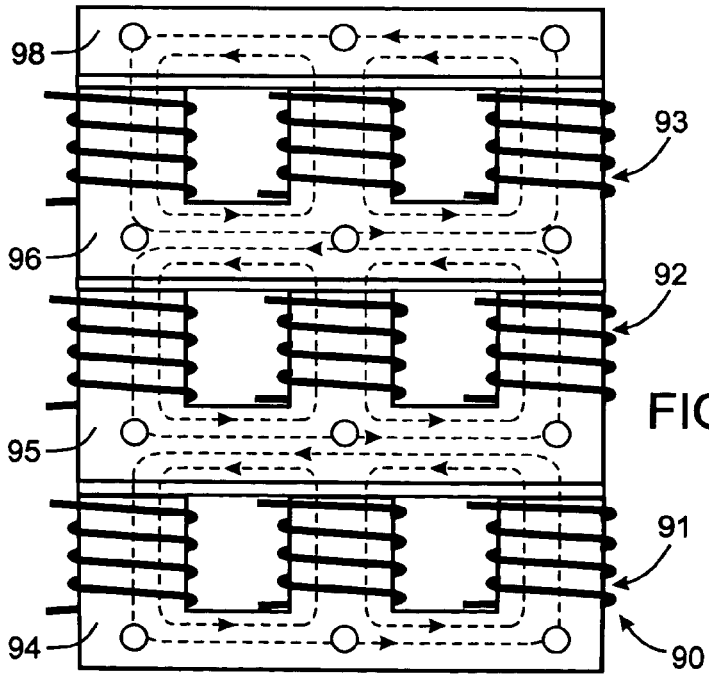
FIG. 9 is another assembly according to the present invention that has a trio of three-phase inductors.

With reference to FIG. 9, additional inductors can be provided on the same assembly. For example, inductor assembly 90 has a trio of three-phase inductors 91, 92, and 93, each comprising three coils wound on legs of E-shaped core elements 94, 95 and 96. The remote ends of the legs of the first core element 94 are spaced from the adjacent second core element 95 and the remote ends of the legs of the second core element 95 are spaced from the third core element 96. The remote ends of the legs of the third core element 96 are spaced from a separate core bridge 98. A greater number of inductors can be stacked in a similar manner.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

The invention is:

1. An electrical inductor assembly comprising:

a first core bridge of magnetically permeable material;

a second core bridge of magnetically permeable material and located substantially parallel to the first core bridge;

a third core bridge of magnetically permeable material and located substantially parallel to the second core bridge;

first, second and third legs of magnetically permeable material between the first core bridge and the second core bridge with a transverse gap along each of the first, second and third legs;

fourth, fifth and sixth legs of magnetically permeable material, each one between the second core bridge and the third core bridge with a transverse gap along each of the fourth, fifth and sixth legs; and first, second, third, fourth, fifth and sixth electrical coils each wound around a different one of the first, second, third, fourth, fifth and sixth legs, wherein electric currents flowing through the first, second, third, fourth, fifth and sixth electrical coils produce magnetic flux which flows through the second core bridge.

2. The electrical inductor assembly as recited in claim 1 wherein magnetic flux produced by the first, second, and third electrical coils flows through the second core bridge in an opposite direction to magnetic flux produced by the fourth, fifth and sixth electrical coils thereby producing a magnetic flux in the second core bridge that is less than a sum of the magnetic fluxes in each of the first, second, third, fourth, fifth and sixth legs.

3. The electrical inductor assembly as recited in claim 1 wherein the first electrical coil is connected to the fourth electrical coil wherein current flowing there through produces magnetic flux flowing through the second core bridge in opposite directions, the second electrical coil is connected to the fifth electrical coil wherein current flowing there through produces magnetic flux flowing through the second core bridge in opposite directions, and the third electrical coil is connected to the sixth electrical coil wherein current flowing there through produces magnetic flux flowing through the second core bridge in opposite directions.

4. The electrical inductor assembly as recited in claim 1 wherein the first leg, the second leg, and the third leg are attached to the second core bridge.

5. The electrical inductor assembly as recited in claim 1 wherein the fourth leg, the fifth leg and the sixth are attached to the third core bridge.

6. The electrical inductor assembly as recited in claim 1 wherein each of the first, second, third, fourth, fifth and sixth legs and the first, second and third core bridges is formed by laminations of a plurality of metal plates.

7. The electrical inductor assembly as recited in claim 1 wherein the first, second, third, fourth, fifth and sixth legs and the first, second and third core bridges are formed by a plurality of wound segments of magnetically permeable material.

8. The electrical inductor assembly as recited in claim 1 wherein the first, second, third, fourth, fifth and sixth legs and the first, second and third core bridges are formed by a plurality of inner segments abutting each other in a two dimensional array wherein each inner segment is formed as a wound spiral of magnetically permeable material, and an outer segment formed as a spiral of magnetically permeable material that is wound around the plurality of inner segments.

9. The electrical inductor assembly as recited in claim 1 wherein the first, second, third, fourth, fifth and sixth legs and the first, second and third core bridges are fastened to a bracket that is fabricated of a low magnetically permeable material.

10. The electrical inductor assembly as recited in claim 1 wherein the fourth, fifth and sixth electrical coils each has an intermediate tap.

11. The electrical inductor assembly as recited in claim 1 wherein each of the fourth, fifth and sixth electrical coils is divided into two segments connected in series with a tap there between, wherein each segment is wound on a separate section of a double bobbin that has an intermediate wall separating the two segments of the electrical coil.

12. An electrical inductor assembly comprising:

a magnetically permeable first core element having a first core bridge from one side of which extend first, second and third legs each having a remote end;

a magnetically permeable second core element having a second core bridge from one side of which extend fourth, fifth and sixth legs each having a remote end, wherein the second core bridge is adjacent to and spaced from the remote ends of the first, second and third legs thereby being magnetically coupled to the first core element;

a magnetically permeable third core bridge spaced from and extending across the fourth, fifth and sixth legs thereby being magnetically coupled to the second core element; and first, second, third, fourth, fifth and sixth electrical coils each wound around a different one of the first, second, third, fourth, fifth and sixth legs; wherein magnetic flux produced by the first, second, and third electrical coils flows through the second core bridge such that the magnetic flux in the second core bridge that is less than a sum of the magnetic fluxes in each of the first, second, third, fourth, fifth and sixth legs.

13. The electrical inductor assembly as recited in claim 12 wherein the first electrical coil is connected to the fourth electrical coil so that current flowing there through produces magnetic flux flowing through the second core bridge in opposite directions, the second electrical coil is connected to the fifth electrical coil so that current flowing there through produces magnetic flux flowing through the second core bridge in opposite directions, and the third electrical coil is connected to the sixth electrical coil so that current flowing there through produces magnetic flux flowing through the second core bridge in opposite directions.

14. The electrical inductor assembly as recited in claim 12 wherein each of the first, second, third, fourth, fifth and sixth legs and the first, second and third core bridges is formed by laminations of a plurality of metal plates.

15. The electrical inductor assembly as recited in claim 12 wherein the first, second, third, fourth, fifth and sixth legs and the first, second and third core bridges are fastened between a pair of brackets that are fabricated of a low magnetically permeable material.

16. The electrical inductor assembly as recited in claim 12 wherein the fourth, fifth and sixth electrical coils each has an intermediate tap.

17. The electrical inductor assembly as recited in claim 12 wherein each of the fourth, fifth and sixth electrical coils is divided into two segments connected in series with a tap there between, wherein each segment is wound on a separate section of a double bobbin that has an intermediate wall separating the two segments of the electrical coil.

18. In an electrical three-phase filter having three input terminals and three output terminals, an inductor assembly comprising:

a first core element having a first core bridge from one side of which extend first, second and third legs each having a remote end;

a second core element having a second core bridge from one side of which extend fourth, fifth and sixth legs each having a remote end, wherein the second core bridge is adjacent to and spaced from the remote ends of the first, second and third legs thereby being magnetically coupled to the first core element;

a third core bridge spaced from and extending across the fourth, fifth and sixth legs thereby being magnetically coupled to the second core element; and first, second, third, fourth, fifth and sixth electrical coils each wound around a different one of the first, second, third, fourth, fifth and sixth legs and coupled between the input terminals and the output terminals;

wherein current flowing from the input terminals to the output terminals upon passing through the first, second, and third electrical coils produces magnetic flux that flows through the second core bridge in an opposite direction to magnetic flux produced by that current passing through the fourth, fifth and sixth electrical coils, which results in a magnetic flux within the second core bridge that is less than a sum of the magnetic fluxes in each of the first, second, third, fourth, fifth and sixth legs.

19. The electrical inductor assembly as recited in claim 18 wherein the fourth, fifth and sixth electrical coils each has an intermediate tap.

20. The electrical inductor assembly as recited in claim 18 wherein each of the fourth, fifth and sixth electrical coils is divided into two segments connected in series with a tap there between, wherein each segment is wound on a separate section of a double bobbin that has an intermediate wall separating the two segments of the electrical coil.

* * * * *